US005713478A

United States Patent [19]

Habisohn

[11] Patent Number: 5,713,478

[45] Date of Patent: Feb. 3, 1998

[54] METHOD FOR DEACTIVATING SWING CONTROL WITH A TIMER

[76] Inventor: Chris X. Habisohn, 1505 Falcon La., Hoffman Estates, Ill. 60192

[21] Appl. No.: 735,613

[22] Filed: Oct. 23, 1996

[51] Int. Cl.[6] ..... B66C 19/00

[52] U.S. Cl. ..... 212/275; 212/284; 340/685

[58] Field of Search ..... 212/274, 275, 212/276, 284, 286, 329; 340/685

[56] References Cited

U.S. PATENT DOCUMENTS 5,490,601 2/1996 Heissat et al. ..... 212/275

5,526,946 6/1996 Overton ..... 212/275

*Primary Examiner*—Thomas J. Brahan

*Attorney, Agent, or Firm*—Jerome Goldberg

[57] ABSTRACT

A method of automatically deactivating an electronic load oscillation dampener on a crane is presented. In the method, an inching time interval K is determined. In response to motion commands from the crane operator, carriage motion is initiated under the control of the load oscillation dampener so that load swing will be minimized. At the moment motion commands are removed, it is determined whether the time K has expired since the initiation of carriage motion. If the time K has expired, then the load oscillation dampener is deactivated allowing faster and more intuitive response of the crane to operator commands, including a rapid deceleration to a stop. If the time K has not expired, then the load oscillation dampener is kept active, causing load oscillations to be damped for the remainder of the run.

3 Claims, 2 Drawing Sheets

METHOD FOR DEACTIVATING SWING CONTROL WITH A TIMER

FIELD OF THE INVENTION

The present invention relates generally to a method for automatically deactivating a dampening controller that dampens the load swing of the load of a crane.

STATE OF THE ART

Suspension cranes are used to support and transport loads suspended by a variable length rope hoist. The hoist is attached to a carriage which is traversed along a track. It is desirable to reduce oscillation of the load when it is moved by the crane. Variable speed motor drives on cranes allow very fine and smooth control of the carriage and the load on their traversing run. A traversing run is the travel of the carriage from a beginning rest position to an end rest position. Present methods of damping load oscillations have focused on generating a drive signal that, when input into the motor drives controlling the crane carriage's horizontal motion, will produce minimal swing. A load oscillation dampener is that part of the control system that shapes the drive signal in a manner that minimizes the swing of the load. Certain known damping methods use a closed loop with feedback control from the angular deviation of the hoisting rope from rest. In these closed loop methods, the signal corresponding to the magnitude of the deviation of the rope suspending the load from vertical is fed back into a load oscillation dampener. The dampener adjusts the speed signal sent to the motor controlling the horizontal motion of the crane in a manner that will dampen the load. U.S. Pat. No. 5,219,420 by Kiiski and Mailisto, 1993, proposes such a method.

Other known damping methods include open loop controls which do not use angular deviation feedback from the rope. However, open loop methods are limited to insuring that the load will not be oscillating or have minimal swing after a transition from one constant speed to another, assuming the load was initially not swinging. This presumes that no other forces, except gravity and the carriage motor force are acting on the load. In particular, if the load is not swinging at the beginning of a carriage run then it will not be swinging at the end of the run.

In a common open loop technique, the acceleration rate is fixed. A request for a change in speed results in computing an acceleration time that will provide for half the requested speed change at the fixed acceleration rate. The fixed acceleration rate is applied to the motor for the determined acceleration time and then followed by an equal interval of acceleration one-half period later. Accelerations applied in this manner dampen load swing.

A common feature to all electronic load oscillation damping systems is that changes in speed commands cannot be instantly compensated. A certain settling time must elapse before speed changes are entirely compensated. The load oscillation dampener must spread out the carriage accelerations over time to dampen oscillations. This produces a rather awkward motion when one is trying to inch the crane, that is, move the crane a short distance. Once the operator has taken his finger off the energizing control button of the crane, damping motions usually continue for a time. The existence of these uncontrolled damping movements makes it hard for the operator to judge the final distance the crane will travel. Some operators accept this awkwardness and do their best to anticipate the final displacement of the crane. Others prefer to deactivate the load oscillation dampener during inching with an on-off switch.

OBJECT OF THE INVENTION

A primary object of the invention is to provide an automatic method for deactivating a crane load oscillation dampener that dampens the load swing of the load of a crane.

SUMMARY OF THE INVENTION

The invention presented in this patent is a method for deactivating a load oscillation dampener on a crane. The carriage of the crane is driven by a motor means responsive to a drive signal. The drive signal is produced by a motion controller in response to operator motion commands including direction signals. The motion controller includes a load oscillation dampener.

In the inventive method, an inching time interval K is determined. The crane operator applies motion commands to the motion controller. In response to the motion commands, carriage motion is initiated and the load oscillation dampener is activated to produce carriage motion that damps load oscillation. The operator then removes the motion commands. At the moment the motion commands are removed, it is determined whether the time K has expired since the initiation of carriage motion. If the time K has not expired then, at the moment motion commands are removed, the load oscillation dampener is deactivated in order to eliminate uncontrolled motions. If the time K has expired, then the load oscillation dampener is kept active.

Generally, an operator initiates carriage motion by pressing the forward or reverse button on the crane's pendant station. Motion commands are removed when the operator simply removes his finger from the button. Removal of motion commands indicates to the motion controller that the operator desires to stop the carriage. The inching time K would be the time allotted for the crane operator to signal the desire to stop the carriage without the characteristic uncontrolled motions associated with an active load oscillation dampener by simply removing his finger from the button before the time has elapsed. If he does so, the load oscillation dampener is deactivated for the remainder of the run, allowing the crane to respond in the manner the operator is familiar with, such as immediately decelerating to a stop. A greater deceleration rate may be used by the motion controller when the load oscillation dampener is deactivated than when the load oscillation is activated. Also, the load oscillation dampener may be reactivated if motion commands are reapplied to the motion controller before the end of the run of the carriage.

BRIEF DESCRIPTION OF THE DRAWINGS

The present invention may be better understood with reference to the detailed description in conjunction with the following figures where the same reference numbers are employed to indicate corresponding identical elements.

DESCRIPTION OF THE PREFERRED EMBODIMENT

Figure 1:
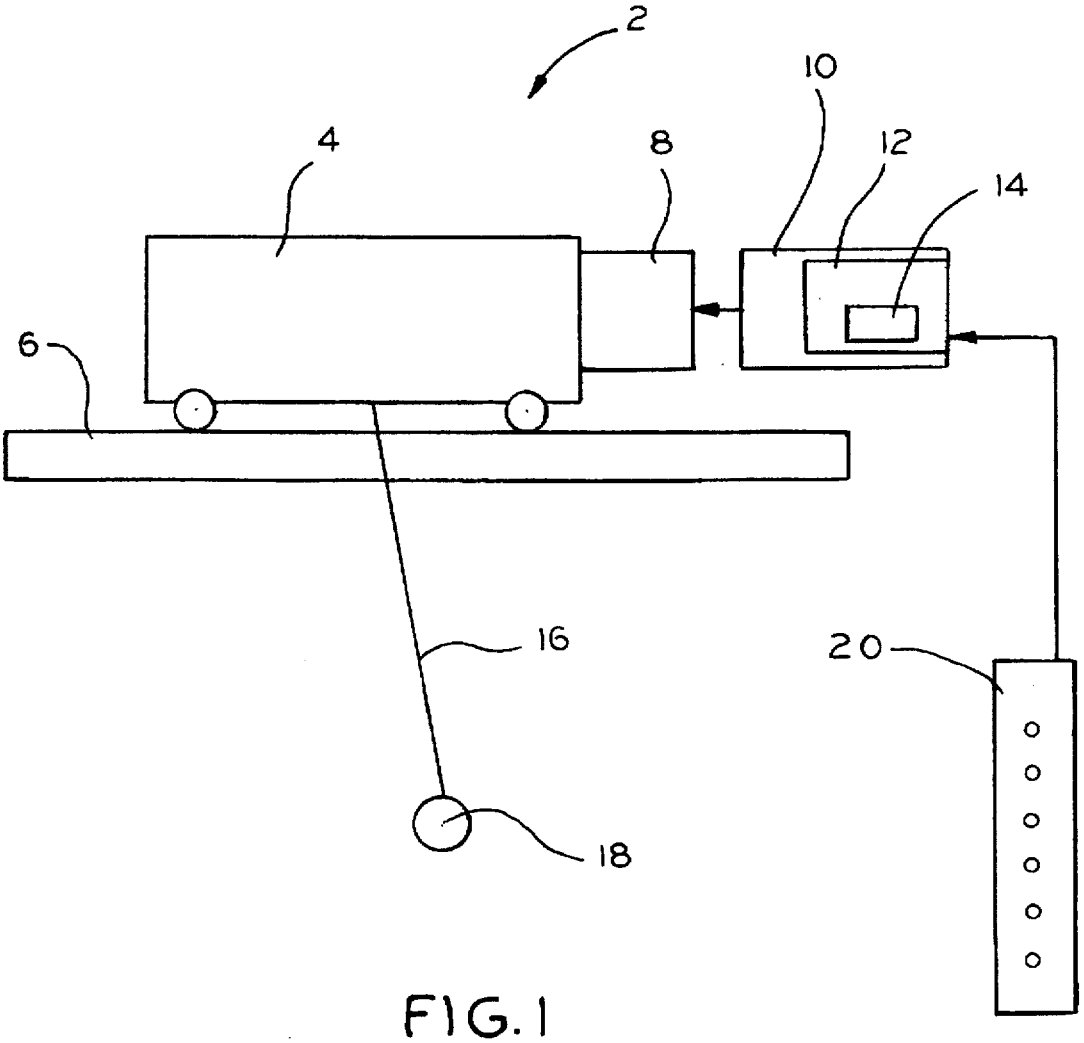
FIG. 1 is a block diagram of a crane system which includes a crane bridge or trolley carriage driven horizontally from one location to another along a track.

FIG. 1, is a block diagram of a crane system 2 which includes a crane bridge or trolley carriage 4 driven horizontally from one location to another along a track 6. The traversing movement of the carriage 4 is powered by a motor 8 which is controlled by a motor drive 10. The motor drive 10 receives a drive signal from a motion controller 12. In this preferred embodiment, the motor 8 is a three phase squirrel cage induction motor, the motor drive 10 may be a variable frequency drive, and the motion controller 12 is embedded into the electronic logic of the drive 10. The motion controller contains a load oscillation dampener 14. The load oscillation dampener 14 shapes the drive signal to move the carriage 4 and simultaneously prevents swinging of a hoisting rope 16 and a load 18 connected to the hoisting rope 16. A motion selector 20 is used by the crane operator to control the desired motion of the carriage 4 along the track 6. Generally, an operator inputs a desired motion such as a direction (forward or reverse) and a desired speed to the motion selector 20 through a push button arrangement. However more complex variable speed selection arrangements may be used.

Figure 2A:
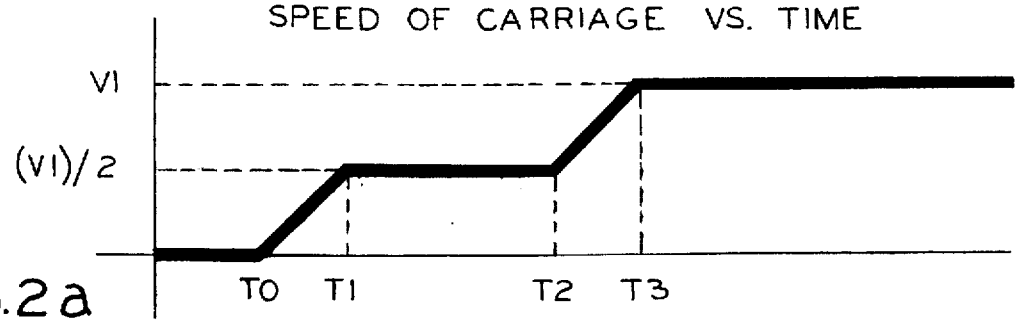
FIG. 2*a* is a graph of the speed of the carriage vs. time which would result if the operator issued an initial motion command for the carriage to attain a speed of V1 in a certain direction with the load oscillation dampener active.

FIG. 2*a* is a graph of the speed of the carriage 4 vs. time which would result if the operator issued an initial motion command for the carriage 4 to attain a speed of V1 in a certain direction with the load oscillation dampener 14 active. The operator issues the initial motion command by pressing a pendant button. In this embodiment it is assumed that the load oscillation dampener 14 operates on the open loop principle that load oscillation can be damped by applying an acceleration interval followed by an equal acceleration one-half period later. This is demonstrated in the FIG. 2*a* by the carriage 4 initially accelerating at time t0 to the velocity (V1)/2 at time t1, followed by an equal acceleration beginning at time t2 and ending at time t3 to attain the desired speed V1. The time between t0 and t2 is one-half of the period of oscillation of the load, presumably the load oscillation period was either programmed into the load oscillation dampener 14 or it was dynamically determined using a rope length sensor. The period of oscillation is derived from the measured rope length using the physical relation that period is proportional to the square root of the rope length.

Figure 2B:
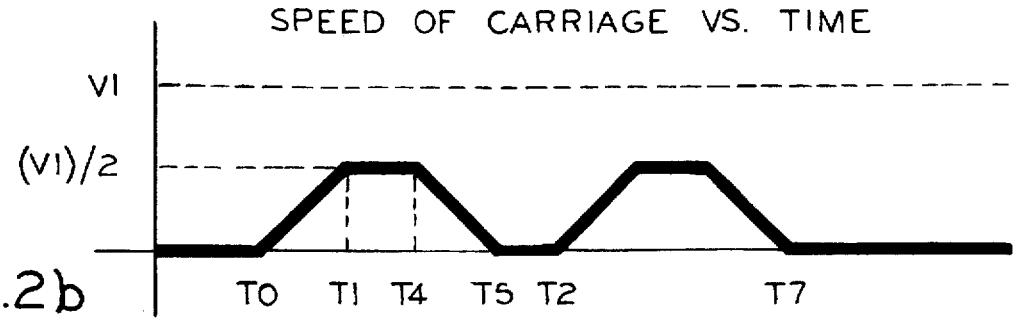
FIG. 2*b* is a graph of the speed of the carriage vs. time which would result if the operator issued an initial motion command for the carriage to attain a speed of V1 in a certain direction with the load oscillation dampener active, but then removed the initial motion command at time t4 by releasing the pendant button with the desire to stop the carriage.

FIG. 2*b* is a graph of the speed of the carriage 4 vs. time which would result if the operator issued an initial motion command for the carriage 4 to attain a speed of V1 in a certain direction with the load oscillation dampener 14 active, but then removed the initial motion command at time t4 by releasing the pendant button with the desire to stop the carriage 4. Immediately, the load oscillation dampener 14 responds by decelerating the load to zero speed at time t5. However, to accomplish its purpose of damping load oscillation, the dampener 14 must cause the carriage 4 to repeat identical accelerations one-half period later. Hence, the extra motion between times t2 and t7 are generated. These extra motions, sometimes called uncontrolled motions, make it difficult to inch the carriage 4. It is desireable that the carriage 4 would decelerate to a stop immediately after the the operator removes the initial motion command, without the uncontrolled motions being generated.

Figure 2C:
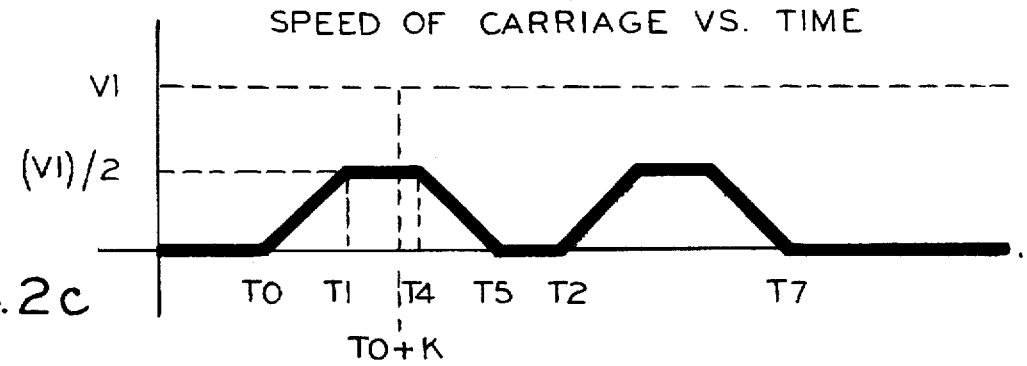
FIG. 2*c* is a graph of the speed of the carriage vs. time where the method of the present invention is employed. The initial motion command is removed after the inching time interval has elapsed; thus the load oscillation dampener remains active and the graph is the same as 2*b*.

In FIG. 2*c* the method of the present invention is employed and an inching time interval K was preset into the motion controller 12. According to FIG. 2*c*, the inching time interval is set for about one-fourth of the period of load oscillation. For a forty foot long hoisting rope, the oscillation period is about 7 seconds. The inching time interval K would then be about 1.75 seconds. FIG. 2*c* is a graph of the speed of the carriage 4 vs. time which would result if the operator issued an initial motion command for the carriage 4 to attain a speed of V1 in a certain direction, but then removed the initial motion command at time t4. Since the initial motion command is removed after the inching time interval has elapsed (i.e. t4>t0+K), the load oscillation dampener 14 remains active and uncontrolled motions occur, but the load is damped.

Figure 2D:
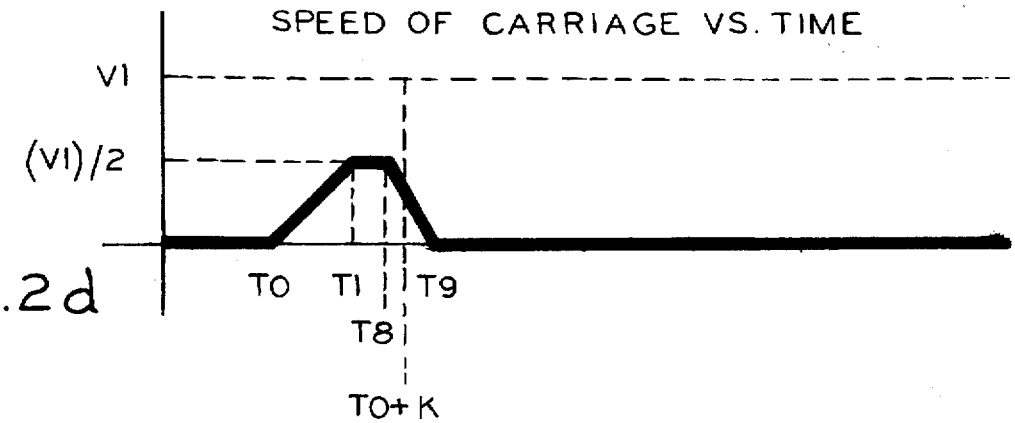
FIG. 2*d* is a graph of the speed of the carriage vs. time where the method of the present invention is employed. The initial motion command is removed before the inching time interval has elapsed; thus the load oscillation dampener is immediately disabled and the load is decelerated quickly to a stop.

In FIG. 2*d* the method of the present invention is employed and an inching time interval K was preset into the motion controller 12. According to FIG. 2*d*, the inching time interval is again set for about one-fourth of the period of load oscillation. FIG. 2*d* is a graph of the speed of the carriage 4 vs. time which would result if the operator issued an initial motion command for the carriage 4 to attain a speed of V1 in a certain direction, but then removed the initial motion command at time t8. Since the initial motion command is removed before the inching time interval has elapsed (i.e. t8<t0+K), the load oscillation dampener 14 is immediately disabled and the load is decelerated to a stop at time t9. Because the uncontrolled motion does not follow, the load will not have its oscillation damped. The deceleration rate used between t8 and t9 does not necessarily have to be equal to the deceleration rates used in the previous graphs. Indeed, the motion controller 12 may have a fast-stop feature where an alternate faster deceleration rate may be employed when the load oscillation dampener 14 is deactivated.

It is a variation of the present inventive method as to whether the inching time interval varies with the determined load oscillation period. The inching time interval could be a preset constant independant of the measured rope length; for example, K could be preset at 2.0 seconds. Conversely, K can be linked to the determined load oscillation period. In particular K can be set as proportional to the determined period. As previously discussed, a rope length sensor can help determine the period. In this proportional method, K may be set at 1.75 seconds for a forty foot rope, but it would scale to 0.875 seconds for a ten foot rope.

The above described embodiment is merely illustrative of the principles of this invention. Other arrangements and advantages may be devised by those skilled in the art without departing from the spirit and scope of the invention. Accordingly, the invention should be deemed not to be limited to the above detailed description but only by the spirit and scope of the claims which follow.

I claim:

1. A method for deactivating a load oscillation dampener on a crane, said load being suspended by a hoisting rope attached to the carriage of the crane, said carriage being driven by a motor means responsive to a drive signal, said drive signal being produced by a motion controller in response to operator motion commands, said motion controller including a load oscillation dampener, said method including the steps of:

(a) determining an inching time interval K;

(b) applying motion commands to said motion controller;

(c) initiating carriage motion and activating said load oscillation dampener to produce carriage motion that damps load oscillation, in response to motion commands;

(d) removing said motion commands from said motion controller;

(e) determining whether the time since the initiation of carriage motion to the moment motion commands are removed exceeds said inching time interval K; and, (f) deactivating said load oscillation if the inching time interval K has not been exceeded, to eliminate uncontrolled carriage motions.

2. A method according to claim 1 including reactivating said load oscillation dampener if motion commands are reapplied to said motion controller before the end of the run of said carriage.

3. A method according to claim 1 wherein a greater deceleration rate is used by the motion controller when said load oscillation dampener is deactivated than when said load oscillation dampener was activated.

* * * * *